US006173477B1

(12) United States Patent
Kikutani et al.

(10) Patent No.: US 6,173,477 B1
(45) Date of Patent: Jan. 16, 2001

(54) GRIP MEMBER, TOOTHBRUSH USING THE GRIP MEMBER AND WESTERN TABLEWARE USING THE GRIP MEMBER

(75) Inventors: Takeshi Kikutani, Tokorozawa; Satoru Kondo; Shunichi Hayashi, both of Nagoya; Kunio Sugihara, Otsu; Teruko Haguri, Kyoto; Kouhei Akimoto, Tsubame, all of (JP)

(73) Assignees: Sunstar Inc., Osaka; Mitsubishi Heavy Industries, Ltd., Tokyo; Aoyoshi Co., Ltd., Niigata, all of (JP)

( * ) Notice: Under 35 U.S.C. 154(b), the term of this patent shall be extended for 0 days.

(21) Appl. No.: 09/242,322

(22) PCT Filed: Jun. 16, 1998

(86) PCT No.: PCT/JP98/02629

§ 371 Date: Feb. 16, 1999

§ 102(e) Date: Feb. 16, 1999

(30) Foreign Application Priority Data

Jun. 17, 1997 (JP) ..... 9-159511

(51) Int. Cl.[7] ..... A45C 13/22; A47J 45/00

(52) U.S. Cl. ..... 16/436; 16/444; 16/446; 16/422; 30/322; 30/324; 15/143.1

(58) Field of Search ..... 16/436, 430, 444, 16/446, 422, 110.1, DIG. 12; D8/DIG. 4; D4/104, 138; 30/322, 323, 324, 123, 340, 342; 15/143.1, 145, 144.1, 144.2, 144.3

(56) References Cited

U.S. PATENT DOCUMENTS

| | | | | |
|---|---|---|---|---|
| 2,989,765 | * | 6/1961 | Gingrich | 15/143.1 |
| 3,204,277 | * | 9/1965 | Visman et al. | 15/143.1 |
| 4,654,921 | * | 4/1987 | Dinner | 15/143.1 |
| 5,075,975 | * | 12/1991 | Wilson | 30/322 |
| 5,373,643 | * | 12/1994 | Warren | 30/322 |
| 5,425,591 | * | 6/1995 | Contreras et al. | 401/191 |
| 5,597,212 | * | 1/1997 | Lewis, Jr. | 300/21 |
| 5,623,739 | * | 4/1997 | Thompson | 15/143.1 |
| 5,765,249 | * | 6/1998 | Axelrod | 15/106 |
| 5,979,005 | * | 11/1999 | Lecce | 15/143.1 |

FOREIGN PATENT DOCUMENTS

| | | |
|---|---|---|
| 49-79080 | 7/1974 | (JP) . |
| 56-18777 | 2/1981 | (JP) . |
| 63-47768 | 3/1988 | (JP) . |
| 250225 U | 4/1990 | (JP) . |
| 454239 U | 5/1992 | (JP) . |
| 546769 | 6/1993 | (JP) . |
| 5507855 | 11/1993 | (JP) . |
| 582202 B2 | 11/1993 | (JP) . |
| 3037043 | 5/1997 | (JP) . |

* cited by examiner

*Primary Examiner*—Chuck Y. Mah

(57) ABSTRACT

A grip member has a grip proper (1) made of a shape-memory resin in the shape of a bar, a connecting pin (4) disposed in one terminal part of the grip proper, a forked part (3) formed integrally in the other terminal side of the grip proper, and an annular part (2) formed integrally slightly toward one end of the grip proper (1) and adapted for enabling the forked part (3) to twine thereon. The grip member is enabled to cope easily with a delicate change in the gripping condition by heating the grip proper (1) and the vicinity thereof to a temperature surpassing the glass transition point of the shape-memory resin thereby endowing the shape-memory rubber with a rubbery state, causing the forked part (3) to twine itself around the annular part (2) in such a manner as to impart the shape of a loop to the grip proper.

21 Claims, 11 Drawing Sheets

GRIP MEMBER, TOOTHBRUSH USING THE GRIP MEMBER AND WESTERN TABLEWARE USING THE GRIP MEMBER

This application is the national phase under 35 U.S.C. §371 of prior PCT International Application No. PCT/JP98/02629 which has an International filing date of Jun. 16, 1998 which designated the United States of America.

TECHNICAL FIELD

This invention relates to a grip member, a toothbrush using the grip member and Western tableware using the grip member more particularly the present invention relates to these implements which prove highly efficient when they are used by aged and physically handicapped persons.

BACKGROUND ART

The toothbrushes available on the market generally have a construction such that a gripping part is flat and is provided at one terminal side of a flat handle shaped like a bar with a brush base supporting planted bristles. When a man in normal health elects to brush his teeth, he is enabled to clean his teeth even to the farthest edges thereof by taking loose hold of the handle and moving the bristles up and down while keeping them in light contact therewith. With aged persons and physically handicapped persons, however, there are times when the handle cannot be gripped with sufficient force and the toothbrush will be freely manipulated only with difficulty because these persons have weak gripping power and are unable to bend their fingers or hands sufficiently. Even for persons in normal health, it is extremely difficult to brush their teeth cleanly within the recesses because the efforts call for a fairly delicate manipulation. Under the circumstances, toothbrushes adapted to facilitate the action of brushing teeth by allowing adjustment of the angle formed between a handle and a brush base have been disclosed as in JUM-A-02-50,225 and JUM-A-04-54,239.

The toothbrush disclosed in JUM-A-02-50,225, for example, provides a brush base 103 supporting planted bristles 102 on one terminal side of a handle 101 and forms part of the handle 101 with a shape-memory resin 104 and, therefore, permits the bristles 102 to be turned in an arbitrarily selected direction by heating the shape-memory resin 104 of the handle 101 to a prescribed temperature thereby imparting flexibility to the shape-memory resin 104, setting the brush base 103 at an arbitrary angle relative to the axial line of the handle 101, and then fixing the shape-memory resin 104 by cooling as illustrated in FIG. 10 (*a*) and FIG. 10(*b*).

Then, the toothbrush disclosed in JUM-A-04-54,239 is enabled to acquire the same function and effect as the toothbrush mentioned above by providing a handle 111 on one terminal side thereof with a brush base 113 supporting planted bristles 112 and forming the handle 111 with a shape-memory resin as illustrated in FIG. 11(*a*)–FIG. (*d*).

In the case of such items of Western tableware as a spoon, a fork, and a knife which are used during a meal as in the case of a toothbrush, aged persons and physically handicapped persons at times experience difficulty in using the Western tableware at will because they have weak gripping power and are unable to bend their fingers or hands sufficiently.

The Western tableware disclosed in JP-B-05-82,202, for example, forms a handle 121 of a spoon 120 with a shape-memory resin having a transition zone temperature above normal room temperature and, therefore, enables the handle 121 to assume easily a shape convenient for use as occasion demands by imparting this shape to the handle 121 while holding this handle 121 at a temperature higher than the transition zone temperature and thereafter transferring the handle 121 to a place held at normal room temperature thereby setting the handle 121 in the newly assumed shape as illustrated in FIG. 12(*a*) and FIG. 12(*b*). Such conventional toothbrushes as disclosed in JUM-A-02-50,225 and JUM-A-04-54,239 are capable of coping with changes in their conditions of use due to delicate variations in the arrangement of teeth among different users by arbitrarily altering relative difference in levels, angle, and twist between the handles 101 and 111 on the one part and the bristles 103 and 113 on the other hand by dint of the disposition of the shape-memory resin to change shape easily to any arbitrary pattern and, at the same time, retain the newly assumed shape intact. The conventional Western tableware which is disclosed in JP-A-05-82,202 can be used even by a physically handicapped person having no free control of hand by enabling this user by wrapping the handle 121 around the hand or nipping it between adjacent fingers in conformity with the contour of the hand by virtue of the disposition of the shape-memory resin to memorize an imparted shape.

The handles 101, 111, and 121 mentioned above, however, cannot cope with delicate changes in the conditions of grip due to the degrees to which the users' fingers and hands are allowed to bend. The condition of grip as well as the size of hand and the magnitude of gripping force allows for infinite variety. Even when the handles 101, 111, and 121 are fabricated from the viewpoint mentioned above, all attempts at enabling the handles 101, 111, and 121 manufactured in specific sizes and shapes to be accepted indiscriminately by the general public inevitably have their limits. When the handles 101, 111, and 121 fail to offer sufficient grip owing to a change in the condition of grip, thereof, the grip must be complemented as by binding them to the users' hands with a cord or a rubber band.

In the light of this true state of prior art, the present invention has for an object thereof the provision of a grip member which enables a user to cope readily with a delicate change in the condition of his grip and enjoy convenience of control and a toothbrush and Western tableware using the grip member.

DISCLOSURE OF THE INVENTION

For the purpose of solving the problems enumerated above, the grip member according to this invention is characterized by comprising a linear grip proper made of a shape-memory resin, a connecting member disposed at one terminal part of the grip proper and adapted to be detachably connected to an attachment member, and an engaging part formed integrally at the other terminal side of the grip proper and adapted to impart to the grip proper the shape of a loop by twining itself around the grip proper and ultimately engaging therewith. Owing to this construction, the grip member can be made to form a grip fitting a given gripping condition and not easily deforming under an external force by heating the grip proper and the vicinity thereof to a temperature surpassing the glass transition point of the shape-memory resin until they assume a rubbery state, deforming the engaging part in such a manner as to twine and pinch itself around an arbitrarily selected portion of the grip proper until it is engaged with the grip proper, meanwhile properly changing the shape of the loop of the grip proper and adjusting the size of the diameter thereof in conformity with the size and the gripping force of the user's hand, and thereafter cooling the grip proper to a temperature below the glass transition point of the shape-memory resin. This grip member, therefore, enables any of an indefinite plurality of users who have hands of varying size and shape and varying gripping force to secure a grip with a high degree of infallibility and enjoy the optimum gripping condition without resorting to the aid of a cord or a rubber band by suitably changing the size of the loop of the grip proper in conformity with the variation in the gripping condition.

The grip member mentioned above is characterized by being provided with an annular part which is integrally formed slightly toward one terminal of the grip proper and is adapted for allowing the engaging part to be wound thereon. When the engaging part is made to twine and pinch itself around this annular part until it is brought into engagement therewith, the rigidity of the grip proper in the gripping direction can be exalted because this engagement helps the grip proper to keep the shape thereof intact.

The grip member mentioned above is characterized by using a polyurethane type resin for the shape-memory resin thereof. Thus, the glass transition point of the shape-memory resin can be arbitrarily set by varying the kinds of raw materials to be used and the molar ratios of the raw materials and the shape-memory resin itself can be easily fabricated as by injection molding.

The grip member mentioned above is characterized by the fact that the glass transition point of the shape-memory resin is higher than body temperature. Thus, the grip member is prevented while in service from the possibility of being deformed by the variation in the modulus of elasticity due to the body temperature.

For the purpose of solving the problems mentioned above, the toothbrush according to this invention makes use of the grip member described above and is characterized by the fact that the attachment member mentioned above constitutes itself a brush proper having bristles thereof planted on a brush base and this brush proper is connected to the connecting member of the grip member. Thus, the toothbrush allows easy use even by aged persons and physically handicapped persons.

Further, for the solution of the problems mentioned above, the Western tableware according to this invention makes use of the grip member mentioned above and is characterized by the fact that the attachment member mentioned above constitutes itself a Western tableware proper such as a spoon proper, a fork proper, or a knife proper and the Western tableware proper is connected to the aforementioned connecting member of the grip member. Thus, the Western tableware allows easy use even by aged persons and physically handicapped persons.

As a result, aged persons and physically handicapped persons are enabled to secure easily an assortment of implements which are easy to use and enjoy a very great convenience. Since the attachment members and the grip members mentioned above can be produced to a unique specification while in conformity with the gripping conditions of individual users, the productivity of these members can be profusely improved and the reduction of cost can be realized.

BEST MODE OF EMBODYING THE INVENTION

The modes of embodying the grip member according to this invention and the toothbrush and the Western tableware making use of the grip member will be described below by reference to FIGS. 1–5.

With reference to FIGS. 1–5, 1 stands for a grip proper formed of a shape-memory resin in the shape of a linear bar, 2 for an annular part integrally formed slightly toward the leading end (one end) of the grip proper 1, 3 for a forked part, i.e. an engaging part formed integrally in the shape of a notched ring on the basal side (the other side) of the grip proper 1 and adapted for causing the grip proper 1 to twine itself, inclusive of the annular part 2, around the grip proper 1 or an attachment member which will be specifically described herein below in such a manner as to impart the shape of a loop to the grip proper 1, and 4 for a connecting pin, i.e. a connecting member made of a metal, disposed as projected in the leading terminal part of the grip proper 1, and adapted to be detachably connected to the attachment member mentioned above.

Now, the function of the grip proper 1 which is made of a shape-memory resin will be described below.

Figure 1:
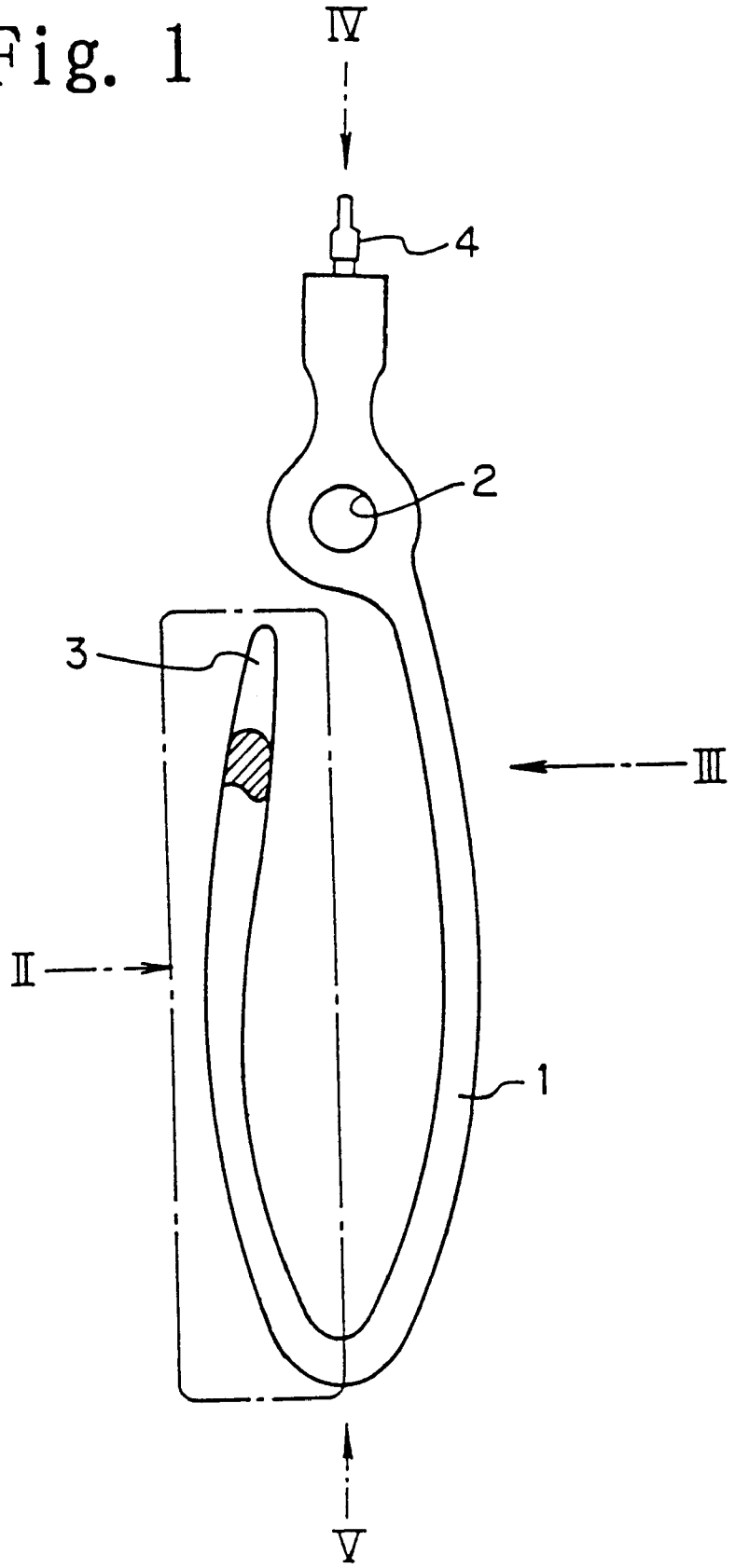
FIG. 1 is a diagram of outward appearance schematically representing the construction of a grip member according to this invention.
Figure 2:
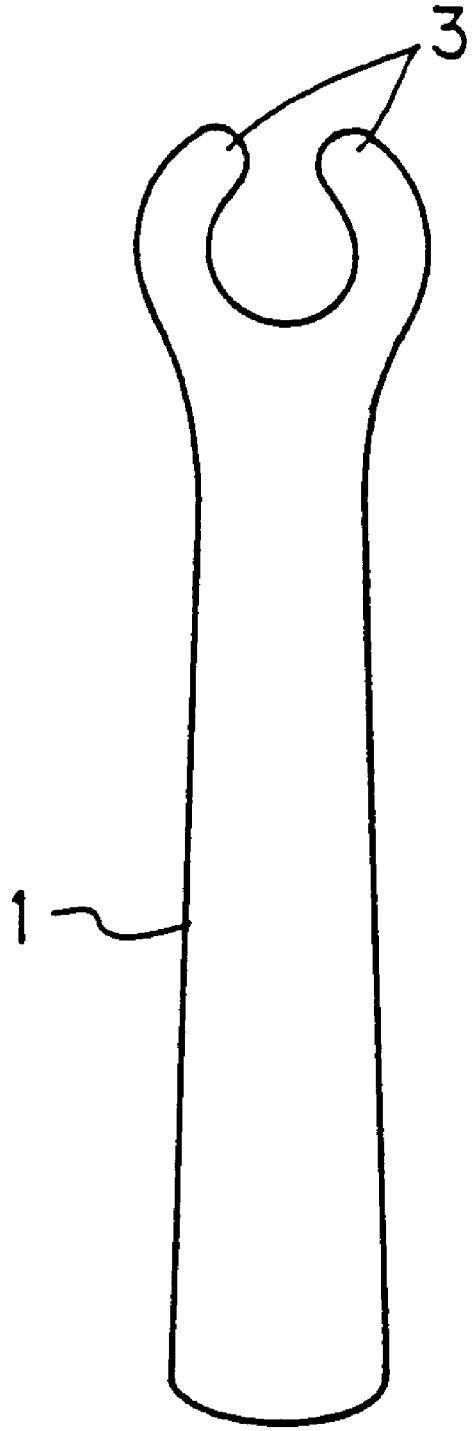
FIG. 2 is a diagram of outward appearance taken through FIG. 1 along an arrow line II from the direction of the arrow line, FIG. 3 a diagram of outward appearance taken through FIG. 1 from the direction of an arrow line III.
Figure 3:
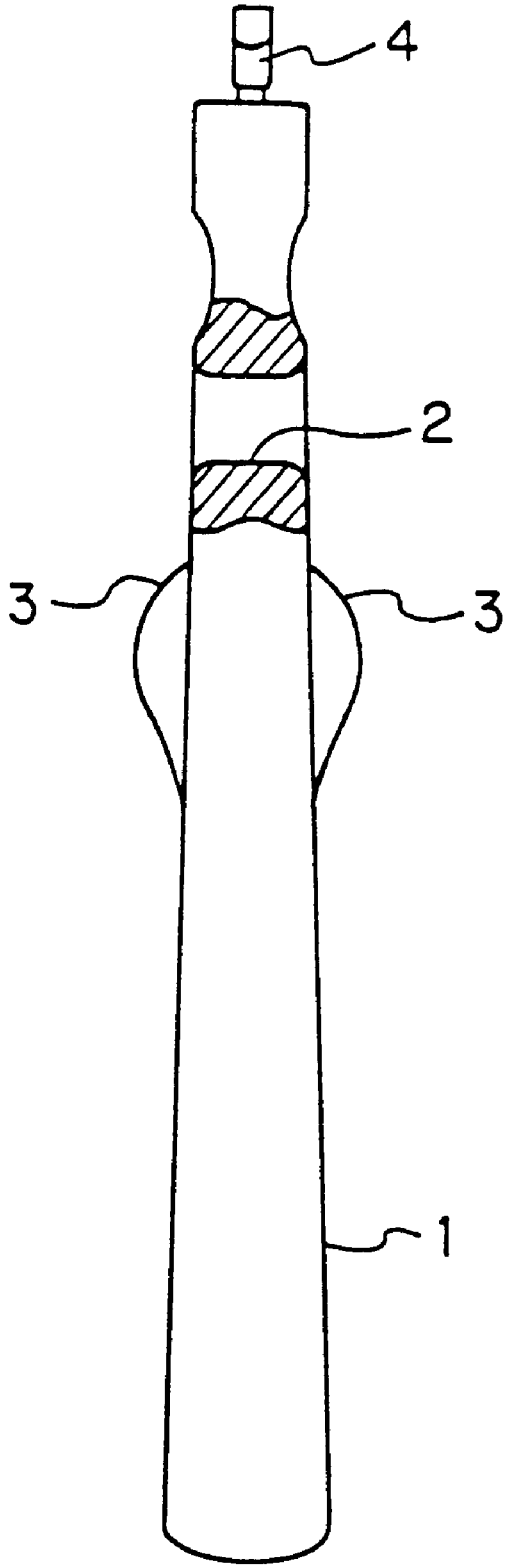
Figure 4:
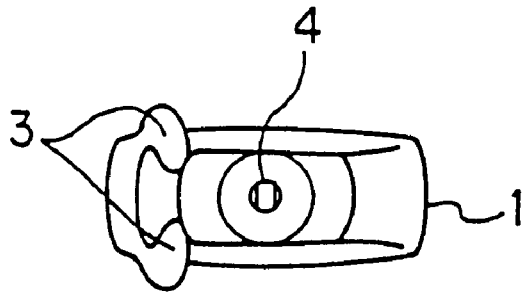
FIG. 4 is a diagram of outward appearance taken through FIG. 1 from the direction of an arrow line IV.
Figure 5:
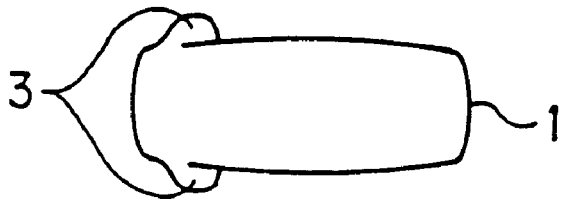
FIG. 5 is a diagram of outward appearance taken through FIG. 1 from the direction of an arrow line V.
Figure 6:
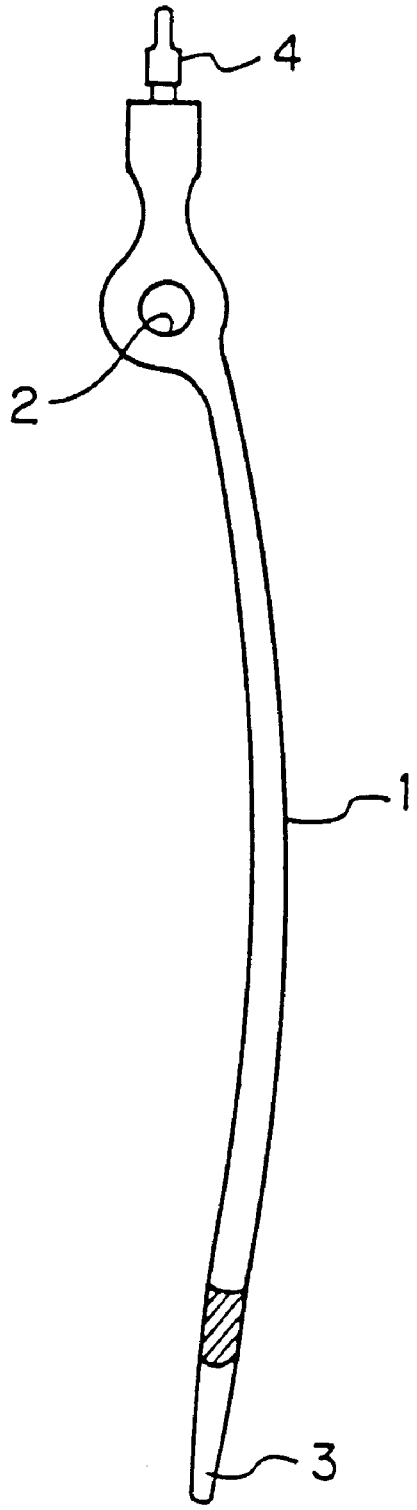
FIG. 6 is a diagram of outward appearance representing the originally molded shape of the grip member of FIG. 1.
Figure 7:
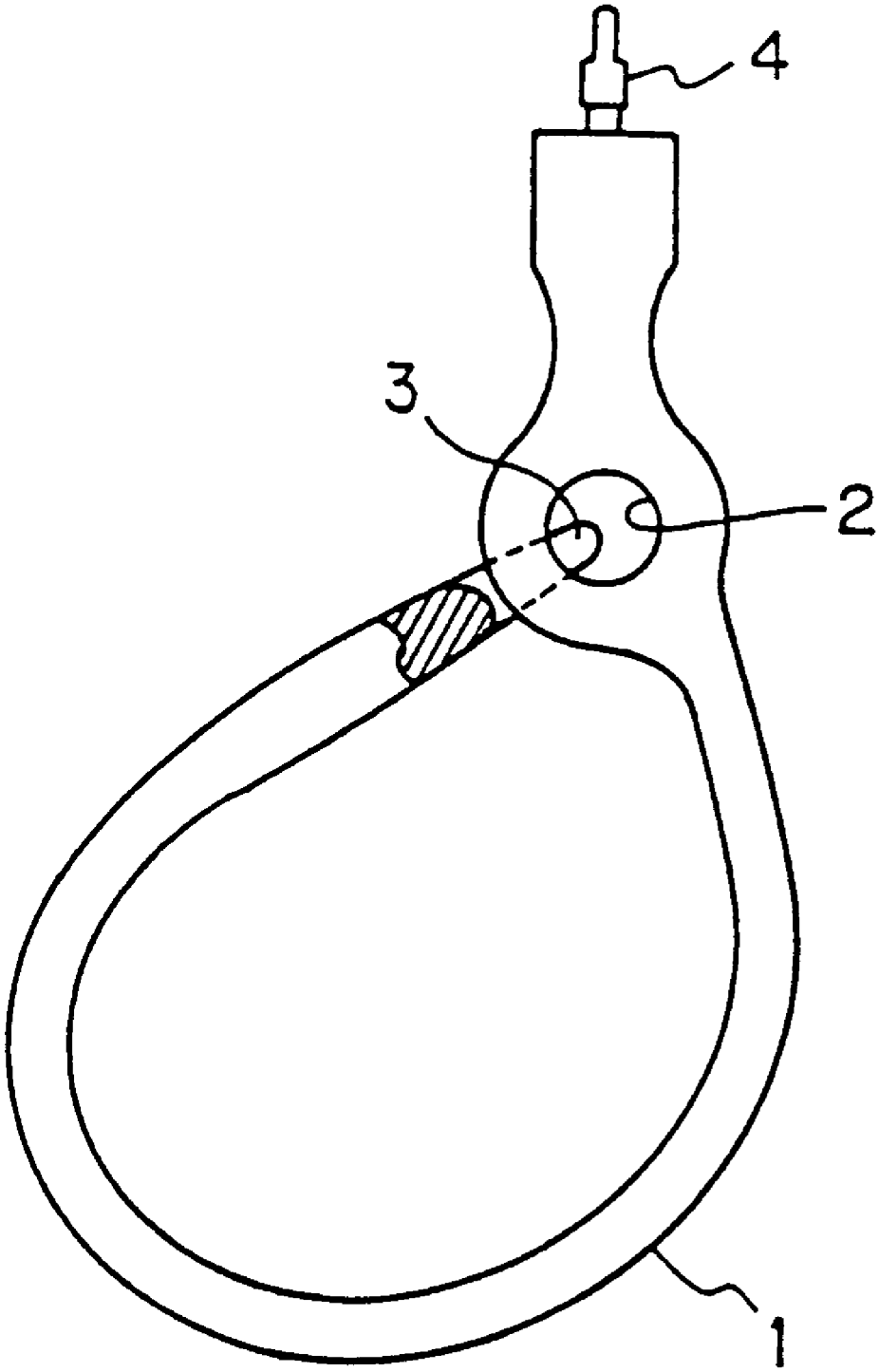
FIG. 7 is a diagram of outward appearance representing the grip member of FIG. 1 caused to assume the shape of a loop, FIG. 8(*a*)–FIG. 8(*c*) are explanatory diagrams depicting the use of a toothbrush utilizing the grip member of FIG. 1, FIG. 9(*a*) and FIG. 9(*b*) are diagrams of outward appearance of a fork utilizing the grip member of FIG. 1, FIG. 10(*a*) and FIG. 10(*b*) are explanatory diagrams depicting one example of the conventional toothbrush, FIG. 11(*a*)–FIG. 11(*d*) are explanatory diagrams depicting another example of the conventional toothbrush, and FIG. 12(*a*) and FIG. 12(*b*) are explanatory diagrams depicting one example of the conventional spoon.

When the grip proper 1 and the vicinity thereof are heated to a temperature surpassing the glass transition point (Tg) of the shape-memory resin, it abruptly changes the modulus of elasticity thereof and assumes a rubbery state and gains freedom of deformation and elongation from the original shape of molding (FIG. 6 refers). The grip proper 1 in this state, on being deformed and elongated or contracted in conformity with the size and the shape of the user's hand and the gripping condition thereof, can be adjusted to such size and shape as fits a varying hand and offers ease of gripping (FIG. 7 refer). When the grip proper 1 which has been deformed and elongated or contracted as described above is cooled to a temperature below the glass transition point (Tg) of the shape-memory resin, it abruptly changes the modulus of elasticity thereof and assumes a vitreous state and sets in a given formed shape. Then, the grip proper 1 can be made to resume the original shape of molding by being heated again to a temperature surpassing the glass transition point mentioned above. By utilizing such peculiar characters of the shape-memory resin as described above, the grip proper 1 can be always made to assume an infallibly fitting shape even when the size and the shape of the user's hand and the gripping force are varied.

The shape-memory resin under discussion is preferred to be a shape-memory polyurethane which uses as raw materials therefor a bifunctional diisocyanate, a bifunctional polyol, an active hydroxyl group-containing bifunctional chain extender, etc. as disclosed as in JP-A-02-92,914. Particularly, the shape-memory polyurethane which is obtained by adopting 4,4'-diphenyl methane diisocyanate (MDI) as the bifunctional diisocyanate, a propylene oxide adduct of bisphenol A as the bifunctional polyol, and 1,4-butanediol as an active hydroxyl group-containing bifunctional chain extender, compounding them at a molar ratio of 2.566:1.000:1.528, and polymerizing the resultant compound assumes a glass transition point (Tg) of 55° C. and proves suitable.

The glass transition point (Tg) of this shape-memory resin is preferred to be set at a level higher than at least the body temperature (36.5° C.) (preferably above 40° C.) lest the resin, while in service, should be caused by the body temperature to change the modulus of elasticity thereof and deform. As the material for the formation of the grip proper 1, the shape-memory polyurethane mentioned above is particularly suitable because the glass transition point thereof can be arbitrarily set by varying the kinds of the raw materials and their molar ratio mentioned above and the shape-memory resin itself can be easily fabricated as by injection molding.

The grip member constructed as described above, therefore, can be made to form a grip fitting a given gripping condition and not easily deforming under an external force by utilizing the peculiar character of the shape-memory resin described above as in heating the grip proper 1 and the vicinity thereof to a temperature surpassing the glass transition point of the shape-memory resin thereby endowing the shape-memory rubber with a rubbery state, causing the forked part 3 to be deformed and enabled to twine and pinch itself around an arbitrary position of the grip proper 1 inclusive of the annular part 2 in such a manner as to impart the shape of a loop to the grip proper 1, meanwhile adjusting properly the diametric size of the grip proper 1 now in the shape of a loop in conformity with the size of the hand and the gripping force of the user, and thereafter cooling the grip proper 1 to a temperature below the glass transition point of the shape-memory resin.

Particularly, when the forked part 3 is made to twine and pinch itself around the annular part 2 and then brought into engagement therewith as illustrated in FIG. 7, it brings the effect of helping the grip proper 1 to keep the shape thereof intact and consequently exalting the rigidity of the grip proper 1 in the gripping direction.

This grip member, therefore, enables any of an indefinite plurality of users who have hands of varying size and shape and varying gripping force to secure a grip with a high degree of infallibility and enjoy the optimum gripping condition without resorting to the aid of a cord or a rubber band by suitably changing the size of the loop of the grip proper 1 in conformity with the variation in the gripping condition.

Figure 8:
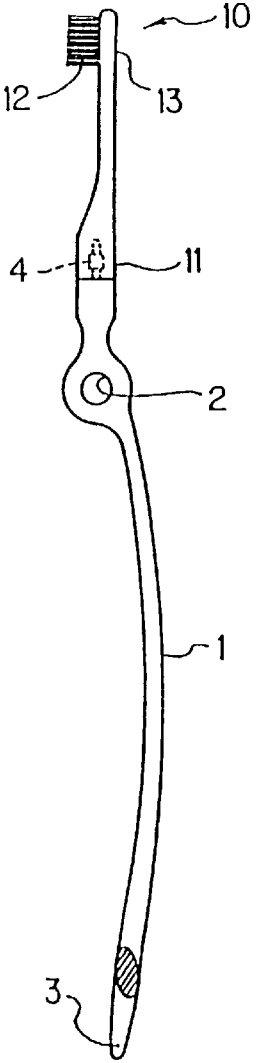
Figure 8:
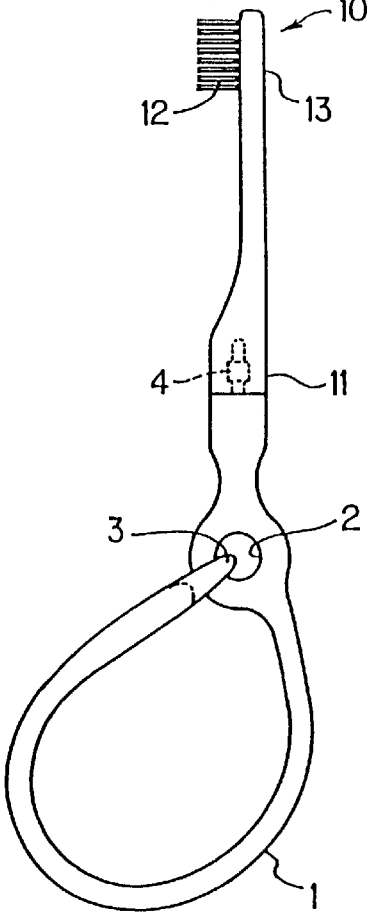
Figure 8:
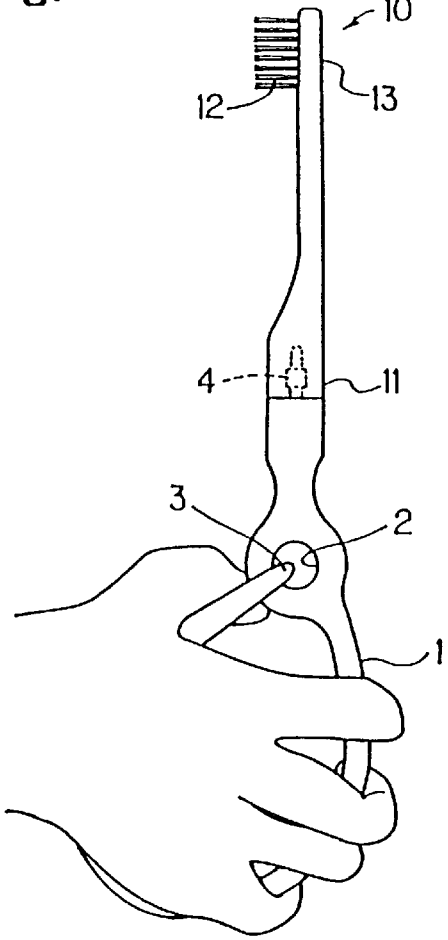
Figure 9:
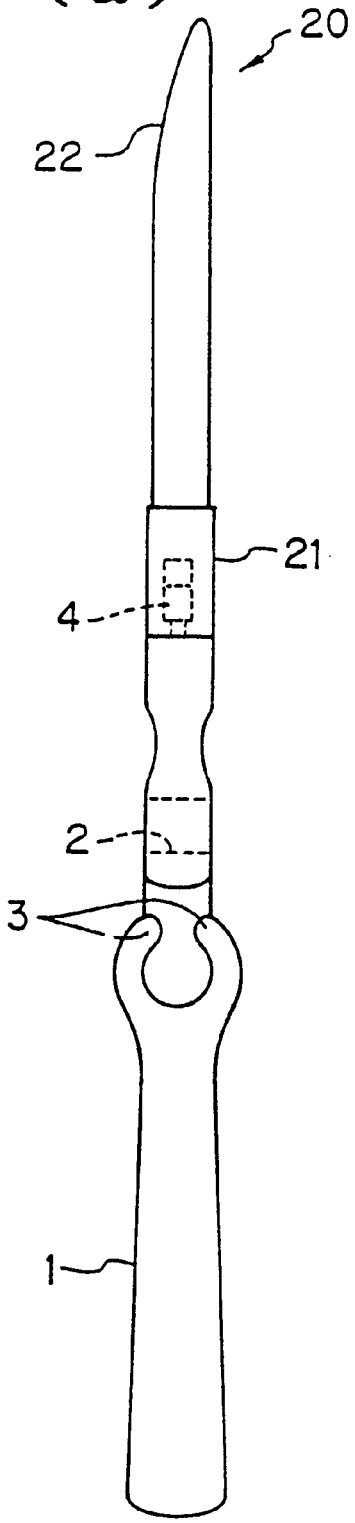
Figure 9:
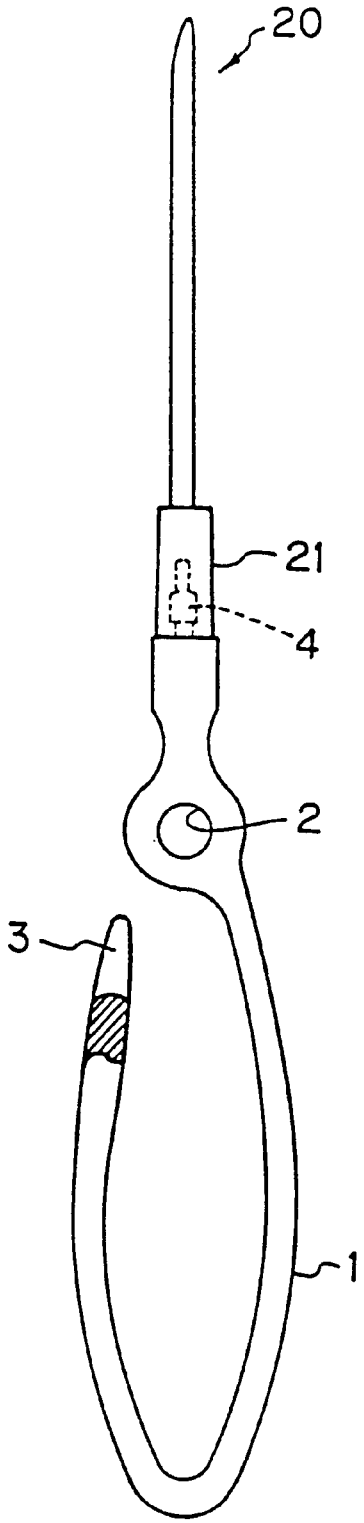
Figure 10:
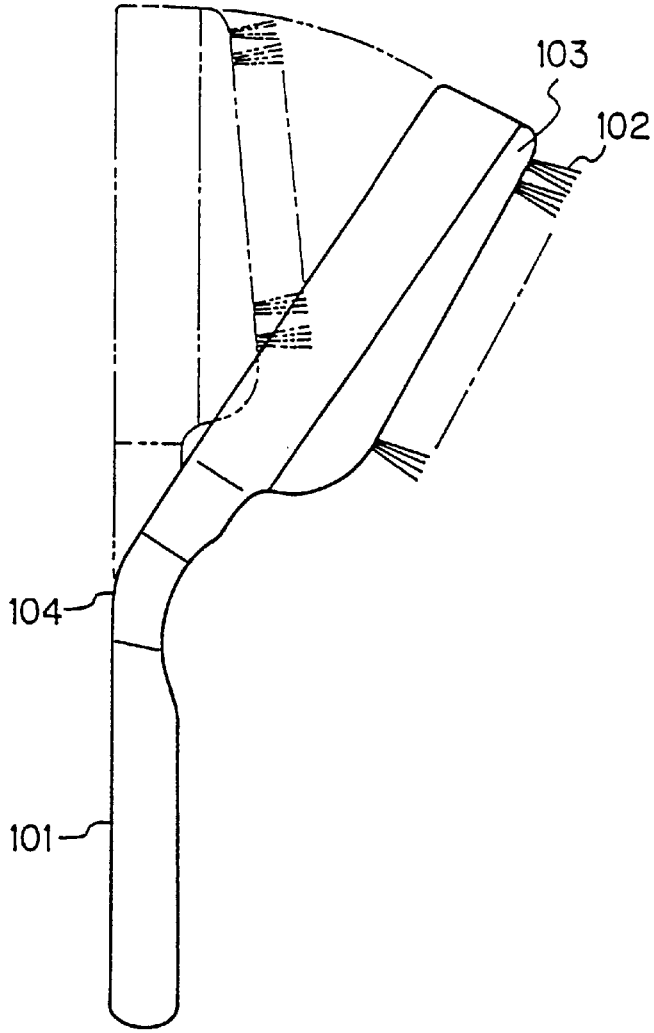
Figure 10:
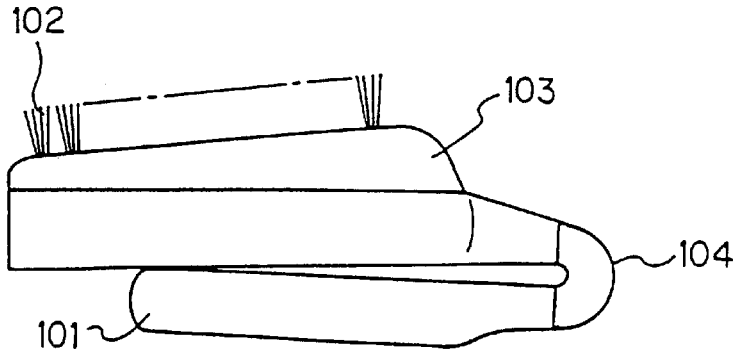
Figure 11:
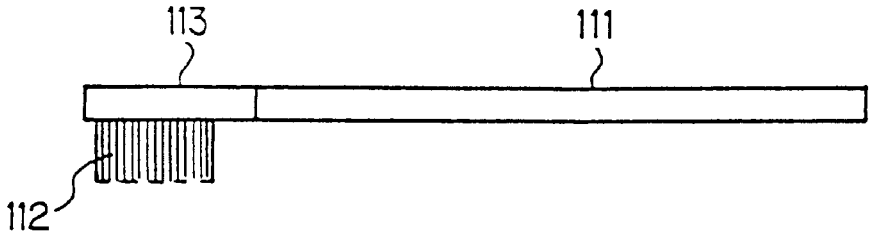
Figure 11:
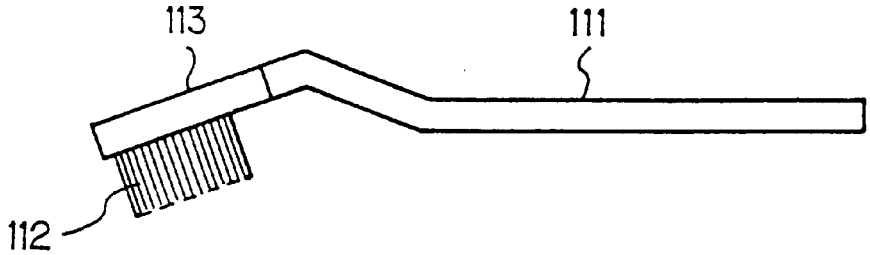
Figure 11:
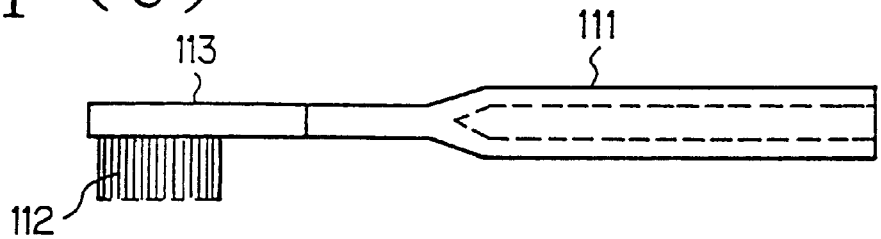
Figure 11:
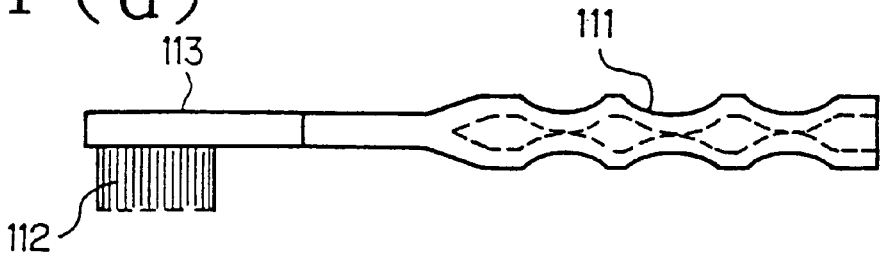
Figure 12:
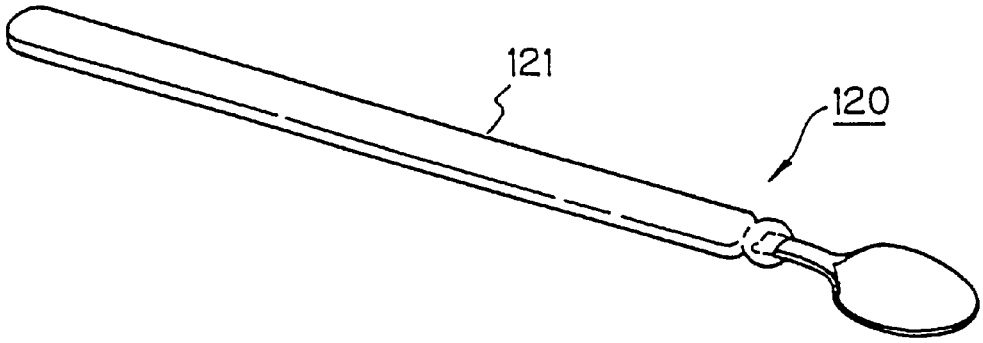
Figure 12:
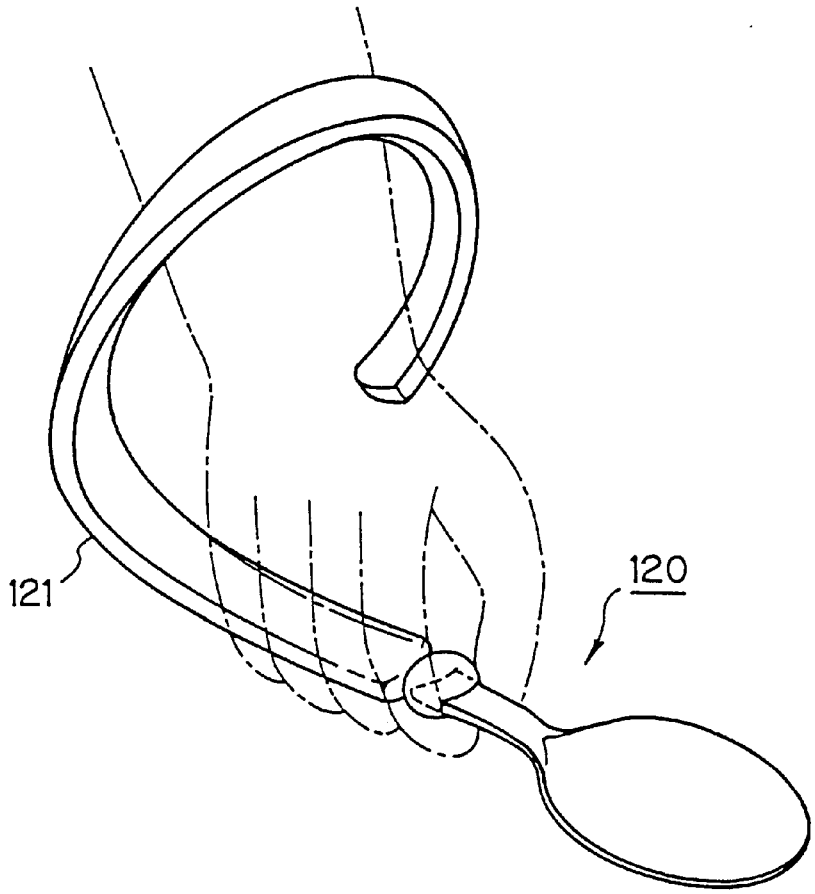

A toothbrush that allows easy use even by aged persons and physically handicapped persons can be constructed by causing a connecting part 11 of a brush proper 10, i.e. an attachment member having bristles 12 planted on a brush base 13, to be inserted home into the aforementioned connecting pin 4 of the grip member for fast union therewith as illustrated in FIG. 8(*a*)–FIG. 8(*c*), for example. Incidentally, since the connecting directions of the connecting part 11 of the brush proper 10 and the connecting pin 4 of the grip proper 1 relative to the peripheral direction are not restricted but are freely set, the direction of the brush proper 10 can be varied without varying the gripping direction of the grip member. Thus, the toothbrush can be always maintained in a gripping condition which allows easy brushing.

A table knife which allows as easy use even by aged persons and physically handicapped persons as the toothbrush mentioned above can be constructed by causing a connecting part 21 of a knife proper 20, i.e. the main body of the table knife destined to form an attachment member provided with a blade part 22, in the place of the brush proper 10 mentioned above, to be inserted home into the connecting pin 4 of the grip member for fast union therewith.

Varying implements that offer easy use even by aged persons and physically handicapped persons, therefore, can be easily collected and used very conveniently by preparing an assortment of attachment members that are adapted invariably to fit the connecting pin 4 of the grip member and permit interchangeable use with the implements in conformity with the functions thereof.

Further, since the attachment members and the grip members mentioned above can be produced to a unique specification while in conformity with the gripping conditions of individual users, the productivity of these members can be profusely improved and the reduction of cost can be realized.

Industrial Applicability

The grip member according to this invention can be made to form a grip fitting a given gripping condition and not easily deforming under an external force by heating the grip proper and the vicinity thereof to a temperature surpassing the glass transition point of the shape-memory resin thereby endowing the shape-memory rubber with a rubbery state, causing the engaging part to be deformed and enabled to twine and pinch itself around an arbitrary position of the grip proper inclusive of the annular part in such a manner as to impart the shape of a loop to the grip proper, meanwhile adjusting properly the diametric size of the grip proper now in the shape of a loop in conformity with the size of the hand and the gripping force of the user, and thereafter cooling the grip proper to a temperature below the glass transition point of the shape-memory resin.

This grip member, therefore, enables any of an indefinite plurality of users who have hands of varying size and shape and varying gripping force to secure a grip with a high degree of infallibility and enjoy the optimum gripping condition without resorting to the aid of a cord or a rubber band by suitably changing the size of the loop of the grip proper in conformity with the variation in the gripping condition. Thus, the toothbrush and the Western tableware that utilize this grip member are highly convenient because they ensure easy use even by aged persons and physically handicapped persons.

What is claimed is:

1. A grip member comprising:

a linear grip proper made of a shape-memory resin, a connecting member disposed in one terminal part of said grip proper and adapted to be detachably connected, to an attachment member, and a first fastener part formed integrally in the other terminal side of said grip proper and adapted to clamp itself around said grip proper and come into engagement with a second fastener part thereof in such a manner as to impart the shape of a loop to said grip proper.

2. A grip member according to claim 1, wherein the second fastener part comprises an annular part, formed integrally slightly toward one end of said grip proper, and adapted for enabling said first fastener part to clamp thereon.

3. A grip member according to claim 2, wherein said shape-memory resin is a polyurethane type resin.

4. A grip member according to claim 2, wherein the glass transition point of said shape-memory resin is higher than the body temperature of the user.

5. A toothbrush using a grip member set forth in claim 2, wherein said attachment member is a brush proper having bristles planted on a brush base and said brush proper is connected to said connecting member of said grip member.

6. A Western tableware implement using a grip member set forth in claim 2, wherein said attachment member is a Western tableware proper such as a spoon proper, a fork proper, or a knife proper and said Western tableware proper is connected to said connecting member of said grip member.

7. A toothbrush using a grip member set forth in claim 3, wherein said attachment member is a brush proper having bristles planted on a brush base and said brush proper is connected to said connecting member of said grip member.

8. A Western tableware implement using a grip member set forth in claim 3, wherein said attachment member is a Western tableware proper such as a spoon proper, a fork proper, or a knife proper and said Western tableware proper is connected to said connecting member of said grip member.

9. A toothbrush using a grip member set forth in claim 4, wherein said attachment member is a brush proper having bristles planted on a brush base and said brush proper is connected to said connecting member of said grip member.

10. A Western tableware implement using a grip member set forth in claim 4, wherein that said attachment member is a Western tableware proper such as a spoon proper, a fork proper, or a knife proper and said Western tableware proper is connected to said connecting member of said grip member.

11. A grip member according to claim 1, wherein said shape-memory member is a polyurethane type resin.

12. A grip member according to claim 11, wherein the glass transition point of said shape-memory resin is higher than the body temperature of the user.

13. A toothbrush using a grip member set forth in claim 12, wherein said attachment member is a brush proper having bristles planted on a brush base and said brush proper is connected to said connecting member of said grip member.

14. A Western tableware implement using a grip member set forth in claim 12, wherein said attachment, member is a Western tableware proper such as a spoon proper, a fork proper, or a knife proper and said Western tableware proper is connected to said connecting member of said grip member.

15. A toothbrush using a grip member set forth in claim 11, wherein said attachment member is a brush proper having bristles planted on a brush base and said brush proper is connected to said connecting member of said grip member.

16. A Western implement using a grip member set forth in claim 11, wherein said attachment member is a Western tableware proper such as a spoon proper, a fork proper, or a knife proper and said Western tableware proper is connected to said connecting member of said grip member.

17. A grip member according to claim 1, wherein the glass transition point of said shape-memory resin is higher than the body temperature of the user.

18. A toothbrush using a grip member set forth in claim 17, wherein said attachment member is a brush proper having bristles planted on a brush base and said brush proper is connected to said connecting member of said grip member.

19. A Western tableware implement using a grip member set forth in claim 17, wherein said attachment member is a Western tableware proper such as a spoon proper, a fork proper, or a knife proper and said Western tableware proper is connected to said connecting member of said grip member.

20. A toothbrush using a grip member set forth in claim 1, wherein said attachment member is a brush proper having bristles planted on a brush base and said brush proper is connected to said connecting member of said grip member.

21. A Western tableware implement using a grip member set forth in claim 1, wherein said attachment member is a Western tableware proper such as a spoon proper, a fork proper, or a knife proper and said Western tableware proper is connected to said connecting member of said grip member.

* * * * *